US008919558B2

(12) United States Patent
Bloch et al.

(10) Patent No.: US 8,919,558 B2
(45) Date of Patent: Dec. 30, 2014

(54) PACKAGED ORAL CARE IMPLEMENT AND PACKAGE

(75) Inventors: Brian Bloch, Hillsborough, NJ (US); David K. Lee, East Brunswick, NJ (US); Alan Sorrentino, Cranbury, NJ (US); Quang Nguyen, Hillsborough, NJ (US); Paul D. Carse, Milford, NJ (US)

(73) Assignee: Colgate-Palmolive Company, New York, NY (US)

( * ) Notice: Subject to any disclaimer, the term of this patent is extended or adjusted under 35 U.S.C. 154(b) by 76 days.

(21) Appl. No.: 13/265,565

(22) PCT Filed: Oct. 5, 2011

(86) PCT No.: PCT/US2011/054938

§ 371 (c)(1),
(2), (4) Date: Oct. 21, 2011

(87) PCT Pub. No.: WO2013/052046

PCT Pub. Date: Apr. 11, 2013

(65) Prior Publication Data

US 2013/0087479 A1 Apr. 11, 2013

(51) Int. Cl.
*B65D 73/00* (2006.01)
*B65D 75/36* (2006.01)

(52) U.S. Cl.
CPC ..... *B65D 75/366* (2013.01); *B65D 2575/362* (2013.01)
USPC ..... 206/469; 206/361

(58) Field of Classification Search
CPC ..... B65D 2575/361; B65D 2575/365; B65D 2575/368; G09F 5/04
USPC ..... 206/461, 467, 469, 472, 361, 470, 526, 206/434; 229/87.05
See application file for complete search history.

(56) References Cited

U.S. PATENT DOCUMENTS

| | | | | |
|---|---|---|---|---|
| 2,673,680 | A | 3/1954 | Deutschmeister et al. | |
| 3,220,543 | A | 11/1965 | McCord et al. | |
| 3,559,799 | A * | 2/1971 | Kramer et al. | 206/469 |
| 3,698,551 | A | 10/1972 | Tomlinson | |
| 4,072,232 | A * | 2/1978 | Marsman et al. | 206/526 |
| 4,236,637 | A * | 12/1980 | Castner et al. | 206/467 |
| 4,266,666 | A * | 5/1981 | Kuchenbecker | 206/461 |

(Continued)

FOREIGN PATENT DOCUMENTS

JP 2003040330 A 2/2003

OTHER PUBLICATIONS

International Search Report and Written Opinion of the International Searching Authority issued in related International Application No. PCT/US2011/054938 mailed Oct. 1, 2012.

*Primary Examiner* — David Fidei
(74) *Attorney, Agent, or Firm* — Judy W. Chung

(57) ABSTRACT

A package for an oral care implement comprising a container having a display portion and a periphery, and a backing attached to the container for defining an interior for receiving an oral care implement. The backing further comprises a first portion attached to a portion of the periphery for defining an interior of the container and a second portion attached to the display portion; wherein the second portion of the backing further comprises a separable portion that facilitates separation of the first portion of the backing from the display portion and thereby facilitates access to the interior of the container.

9 Claims, 6 Drawing Sheets

(56) References Cited

U.S. PATENT DOCUMENTS

| | | | | |
|---|---|---|---|---|
| 4,605,459 | A | 8/1986 | Voltmer et al. | |
| 4,824,143 | A | 4/1989 | Grainger | |
| 5,002,187 | A | 3/1991 | Rysner et al. | |
| 5,209,354 | A | 5/1993 | Thornhill et al. | |
| 5,485,919 | A | 1/1996 | Samberg et al. | |
| 6,059,106 | A * | 5/2000 | Baker et al. | 206/361 |
| 6,230,964 | B1 | 5/2001 | Saito | |
| 6,276,529 | B1 | 8/2001 | Feehan, Jr. | |
| 7,246,709 | B2 | 7/2007 | Kim | |
| 7,356,866 | B2 | 4/2008 | Chan | |
| 7,389,907 | B2 * | 6/2008 | Smith | 229/87.05 |
| 7,753,205 | B2 * | 7/2010 | Shibata et al. | 206/469 |
| 8,261,909 | B2 * | 9/2012 | Sorrentino et al. | 206/362.4 |
| 2003/0226223 | A1 | 12/2003 | Chan | |
| 2005/0044646 | A1 | 3/2005 | Peretz et al. | |
| 2005/0051459 | A1 * | 3/2005 | Casanova | 206/703 |
| 2005/0218028 | A1 * | 10/2005 | Vestal et al. | 206/471 |
| 2007/0125679 | A1 | 6/2007 | Smith | |
| 2009/0184017 | A1 | 7/2009 | Doherty | |
| 2009/0313801 | A1 | 12/2009 | Jimenez et al. | |
| 2010/0230312 | A1 | 9/2010 | Sorrentino et al. | |

* cited by examiner

PACKAGED ORAL CARE IMPLEMENT AND PACKAGE

CROSS-REFERENCE TO RELATED APPLICATION

This application is a national stage application of Patent Cooperation Treaty Patent Application No. PCT/US/US2011/54938, filed Oct. 5, 2011, the contents of which are incorporated herein by reference.

FIELD OF THE INVENTION

The present invention relates generally to the field of packaging, and specifically to packaged oral care implements with easy-open features to facilitate access to the oral care implements.

BACKGROUND OF THE INVENTION

In the commercialization of toothbrushes, the current trend is to package toothbrushes in blister packages. While the use of blister packages has proved to be cost-effective and effective at adequately protecting the toothbrush contained therein, existing blister packages are often difficult to open. While easy-open blister packages have been introduced into the art, existing easy-open blister packages are either complex to manufacture and/or compromise the containment of the product. Still a further issue with existing easy-open blister packages is that sharp protruding edges may be exposed that can prevent shipping, cause inadvertent opening, and/or injury to the end user. Thus, a need exists for an improved easy-open blister package that eliminates one or more of the aforementioned deficiencies.

BRIEF SUMMARY OF THE INVENTION

A package for an oral care implement comprises, in one embodiment, a container having a display portion, a periphery and an interior for receiving an oral care implement, a backing attached to the container and further comprising a first portion attached to a portion of the periphery for enclosing the interior and a second portion attached to the display portion; wherein the second portion of the backing further comprises a separable portion that facilitates separation of the first portion of the backing from the display portion to thereby facilitate access to the interior of the container. In one embodiment, the severing or separation of the second portion of the backing relative to the first portion of the backing results in the initial opening along the periphery and access to the interior, and facilitates the subsequent removal of the first portion of the backing from the periphery of the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
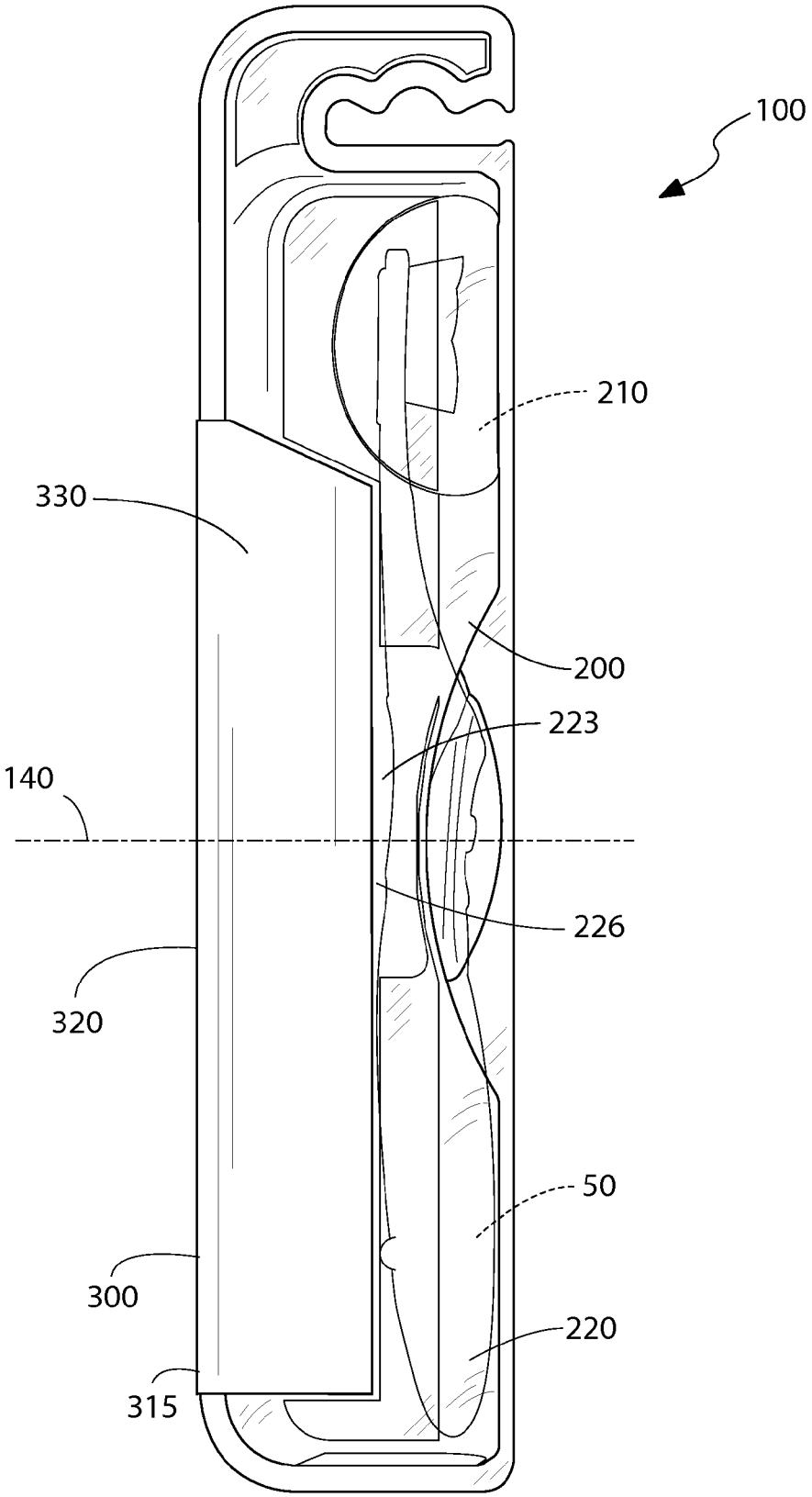
FIG. 1 is a front view of one embodiment of an assembled package for an oral care implement in accordance with the present disclosure.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
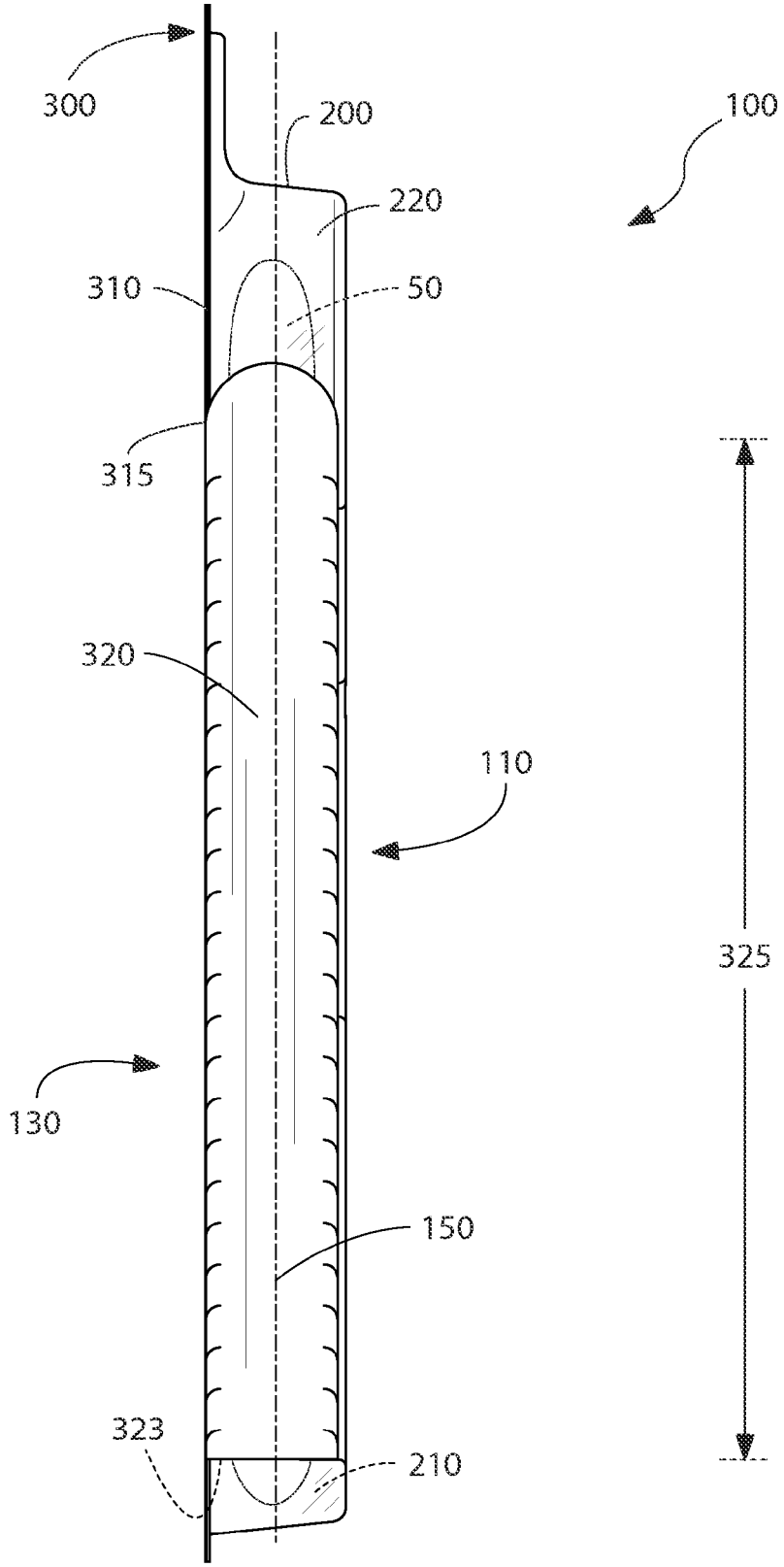
FIG. 2 is a right side thereof.
Figure 3:
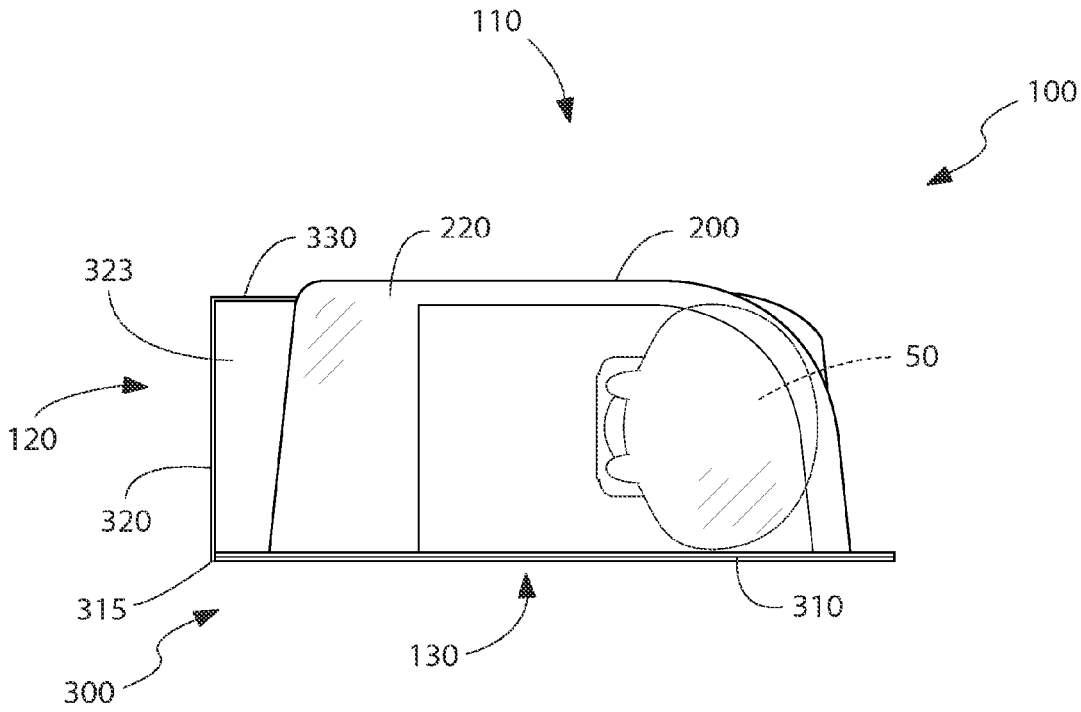
FIG. 3 is a bottom view thereof.

Referring to FIGS. 1-3, an embodiment of an assembled, easy-open package 100 for an oral care implement 50 (such as a toothbrush or the like) is provided. While a toothbrush 50 is illustrated and described, it will be appreciated that embodiments of the package 100 described herein may be used to retain other than oral care implements if desired. However, for purposes of explanation and convenience, the oral care implement 50 will be illustrated and described as a toothbrush or as implement 50.

The package 100 generally comprises a container 200 (shown separately in FIG. 4), and a wrapper or a backing 300 (shown in its entirety in FIG. 5) that engages portions of the container 200 to define an interior 210 therebetween for housing an implement 50 as shown, for example, with reference to the assembled package 100 in FIGS. 1-3. The container 200 further comprises a display portion 220 along a front 110 of the package 100 that permits visual inspection of preferably the full length of implement 50 retained with the interior 210. In the disclosed embodiment, the backing 300 is primarily attached to a periphery 230 of the container 200 along a back 130 of the package 100 and preferably extends from the back 130, across a side 120, and to the front 110 of the package 100. The container 200 is preferably formed from a clear, flexible plastic of the type typically used with a traditional blister package that permits a user to compress portions of the display portion 220 using finger strength alone and thereby sense the contours of the enclosed implement 50. This might be useful if an enclosed oral care implement includes a "try me" feature (not shown) that is activated by impacting the implement through the display portion 220. Of course, while a clear, flexible container 200 is preferred, other constructions may be utilized as desired to accommodate variations in appearance and structure.

Figure 5:
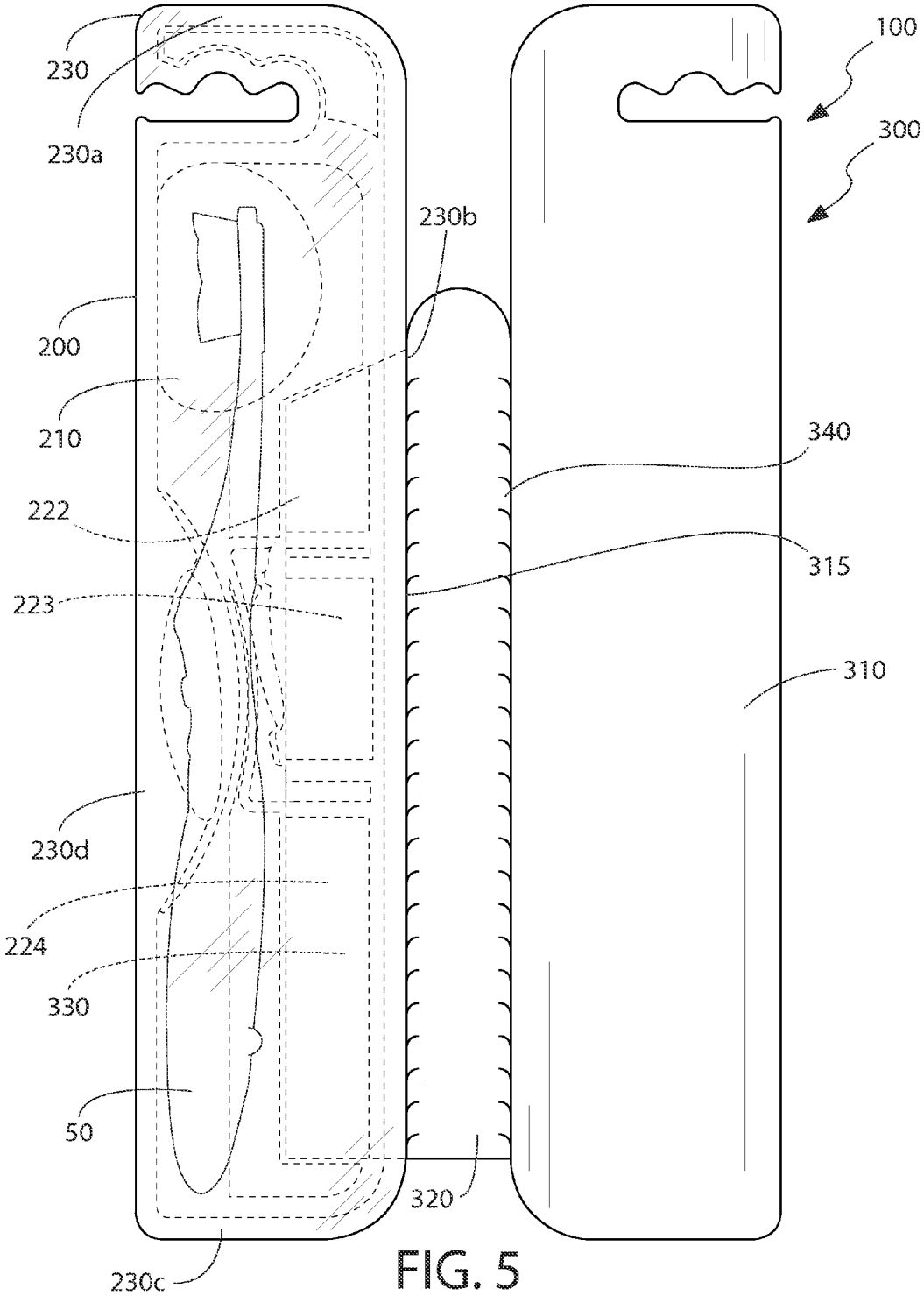
FIG. 5 is a partially assembled view of the package of FIG. 1.

Referring to FIGS. 2, 3 and 5, the backing 300 further comprises a first portion 310 for attachment along the back 130 of the package 100, a second portion 330 for attachment along the front 110 of the package 100, and a connecting portion 320 defined along a side 120 of the package 100 between the first portion 310 and the second portion 330. In the embodiment as shown, the connecting portion 320 effectively forms a spine of the package 100, wherein the connecting portion 320 is arranged in one embodiment to facilitate an easy separation of the backing 300 from the container 200 for access to the oral care implement 50 in the interior 210 as will be described in more detail below. The first portion 310 defines a majority of the surface area of the backing 300 and is typically imprinted with informational material (not shown) about the implement 50 including, but not limited to features, benefits, manufacturer information, directions for use, and marketing information, etc. In some embodiments, the second portion 330 may provide additional space for inclusion of other advertising and/or marketing information relating to the implement 50.

In some embodiments, the first portion 310, second portion 330 and connecting portion 320 of the backing 300 are formed as an integral, one-piece structure that is wrapped around (FIG. 13) the container 200, although such portions 310-330 may be separate components, or may be structurally associated in different ways if desired. However, an integral backing structure accommodates a continuous messaging platform that wraps around the package 100 from the front 110, across the side 120 and to the back 130 as shown, for example, in FIGS. 1-3 and 12-13. The backing 300 may be formed from any material of any size, thickness and cross-section, and each portion 310-330 of the backing 300 or a combination of portions 310-330 may be formed from the same or different material as desired, although typically a backing 300 for a package containing an oral care implement is formed from a relatively thin paper- or plastic-based material that is not too difficult to open.

Figure 4:
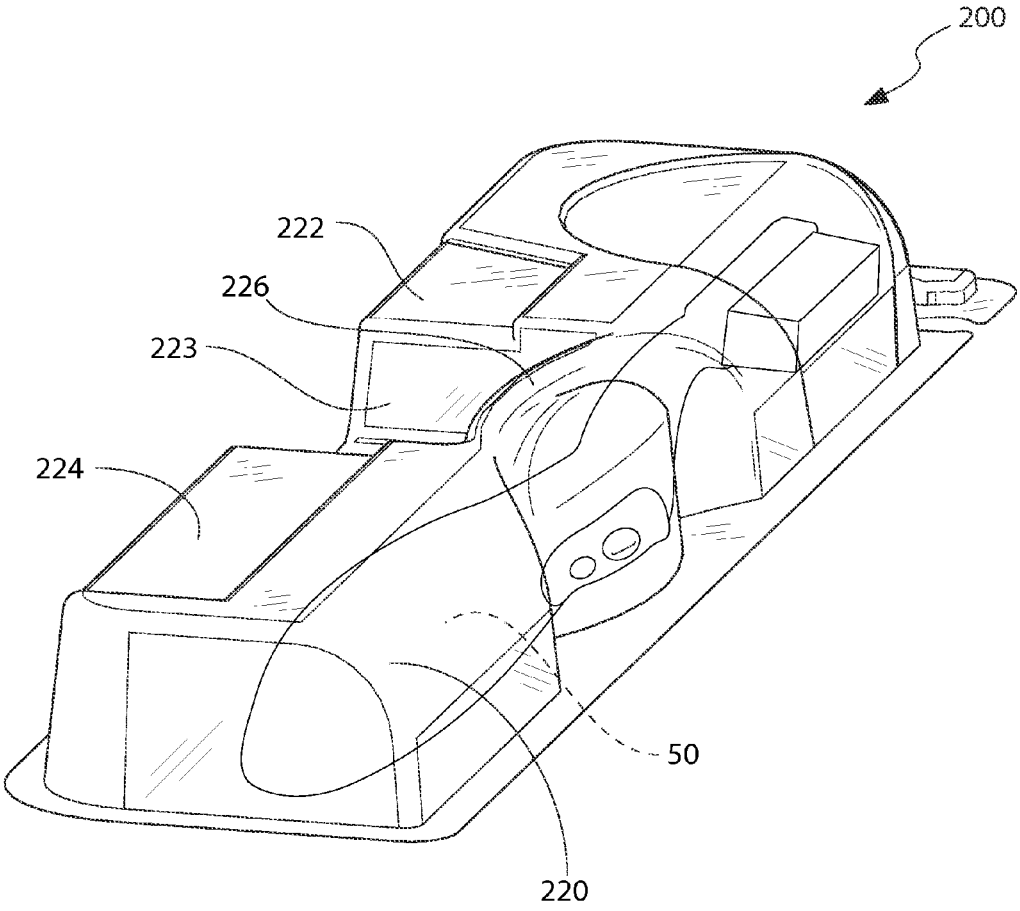
FIG. 4 is a perspective view of one embodiment of a container used in the package of FIG. 1.

The first portion 310 of the backing 300 is preferably attached to the periphery 230 of the container 200, with the periphery being primarily defined by edges 230*a*, 230*b*, 230*c*, and 230*d* (FIG. 5). More specifically, the first portion 310 of the backing is preferably attached to all of the edges of the periphery 230 with the exception of edge 230*b* that is defined at the junction 315 of the first portion 310 and the connecting portion 320 for reasons that are described in more detail below. The second portion 330 of the backing 300 is preferably attached to a first surface 222 and a second surface 224 on the display portion 220 of the container 200 as shown in FIGS. 1, 4, and 5, where the first surface 222 and second surface 224 are preferably separated by a first gap 223. The connecting portion 320 of the backing 300 is preferably unattached to the container 200 and spans between the first portion 310 and second portion 330 of the backing 300 and preferably defines a second gap 323 (FIG. 3) between the connecting portion 320 and the container 200. In some embodiments, the second gap 323 is elongated and spans the length 325 (FIG. 2) of the connecting portion 320. While the present embodiment illustrates an unattached edge 230*b*, it will be appreciated that a different edge along the periphery 230 may be unattached instead of edge 230*b*, and it will also be appreciated that the backing 300 may therefore wrap around a different edge of the periphery 230 other than the edge 230*b*. In addition, while the backing 300 is illustrated as wrapping around only one edge of the container, it will be appreciated that the backing 300 may wrap around more than one edge of the periphery as desired.

In the present embodiment, the initial wrapping of the connecting portion 320 and second portion 330 around the junction 315 and along edge 230*b*, and the attachment of the second portion 330 to the container 200, effectively joins the backing 300 to the edge 230*b* even though the edge 230*b* is preferably not sealed to the backing 300. In such embodiment, the backing 300 may be sealed to the container 200 along the other edges 230*a*, 230*c* and/or 230*d*, such as by an adhesive, heat sealing, welding or the like. Thus, the initial construction of the assembled package 100 provides an easy-open advantage in that the edge 230*b* of the container 200 is effectively unsealed, thereby providing easier access to the interior 210 through such edge 230*b* when it is exposed as described herein, yet the integrity of the assembled package 100 and the packaged oral care implement 50 remains intact by virtue of the wrapping of the backing 300 from the back 130 to the front 110 of the package and over the side 120 of the periphery 230 that is unsealed.

In certain embodiments, one or both of the first and second gaps 223 and 323 provide a user with access and the ability to respectively manipulate the second portion 330 and/or connecting portion 320 of the backing 300 to facilitate separation of the backing 300 from the container 200. In one non-limiting example, a user may gain access to the first gap 223 by inserting a portion of a finger into the first gap 223 and lifting the second portion 330 of the backing 300 to detach the second portion 330 from the first and second surfaces 222 and 224 of the container 200. This lifting movement may be along a lateral plane 140 of the package 100 as shown in FIG. 1. Once the second portion 330 is detached from the container 200, the second portion 330 and connecting portion 320 may be rotated together about the junction 315 of the first portion 310 and the connecting portion 320. Since the backing 300 is preferably not connected along the edge 230*b* of the periphery 230 of the container 200 that coincides with the junction 315, the detachment of the second portion 330 from the container 200 results in an initial separation of the backing 300 from the container 200 along the edge 230*b* that allows for an opening into the interior 210 along the edge 230*b*. The subsequent rotation of the combined second portion 330 and connecting portion 320 about the junction 315 functions to enlarge the separation of the backing 300 along the edge 230*b*. Thereafter, the backing 300 may be pulled off or otherwise removed from the attached edges 230*a*, 230*c*, and 230*d* of the periphery 230 using leverage provided by the combined surface area of the second portion 330 and connecting portion 320, with the second portion 330 effectively functioning as a pull handle. In this example, the initial wrapping of the connecting portion 320 and second portion 330 around the junction 315 and along edge 230*b*, and the attachment of the second portion 330 to the container 200 effectively joins the backing 300 to the edge 230*b* even though the edge 230*b* is preferably not sealed to the backing 300 as along the other edges 230*a*, 230*c* and/or 230*d*, such as by an adhesive, heat sealing, welding or the like.

In another non-limiting example, a user may utilize the second gap 323 to sever the attachment of the first portion 310 of the backing from the second portion 330 of the backing 300 using a variety of methods. In one embodiment, the second gap 323 may provide an access that enables a user to insert a portion of a finger into the second gap 323 and tear the connecting portion 320 away from the first and second portions 310, 330 of the backing 300, thereby resulting in an opening of the container 200 along the edge 230*b* by virtue of the first portion 310 no longer being held against the periphery 230 of the container 200. In this embodiment, the connecting portion 320 may be formed from a material that is weaker or less resistant to tearing than one of the first portion 310 or the second portion 330, and an informational or instructional guide may be provided along or adjacent the connecting portion 320 that instructs a user on how to tear or sever the connecting portion 320. Of course, instead of tearing away a portion of the connecting portion 320, a user may simply cause a separation in the connecting portion 320 relative to the first portion 310 by running a finger, a tool or the like through the connecting portion 320 and along the length 325 of the second gap 323 using a sliding motion similar to the opening of an envelope. In some embodiments, the connecting portion 320 may be provided with a tear strip defined by one or more weakened portions 340, such as one or more score lines and/or perforations. In some embodiments, the entirety of the connecting portion 320 may be the tear strip. In each of these non-limiting examples, the connecting portion 320 facilitates breaking of the connection between the first portion 310 and second portion 330 and the separation of the engagement of the backing 300 against the unsealed edge 230*b* as described above. In the embodiment as shown in FIG. 5, a tear strip is provided with two weakened portions 340 are included along two opposing edges of the connecting portion 320. Each of the two weakened portions 340 include a plurality of angled score lines. In some embodiments, the score lines may be provided at an angle of about 15° to about 75°. In some embodiments, the score lines may be provided at an angle of about 30° to about 60°. The tear strip also includes a tab that allows a user to grab onto. The tab and the angled score lines facilitate the removal of the tear strip from the rest of the package 100. While the embodiment as shown included symmetrical angled score lines along opposing sides of the connecting portion 320, it is contemplated that asymmetrical and/or non-angled score lines may be used in other embodiments.

Figure 6:
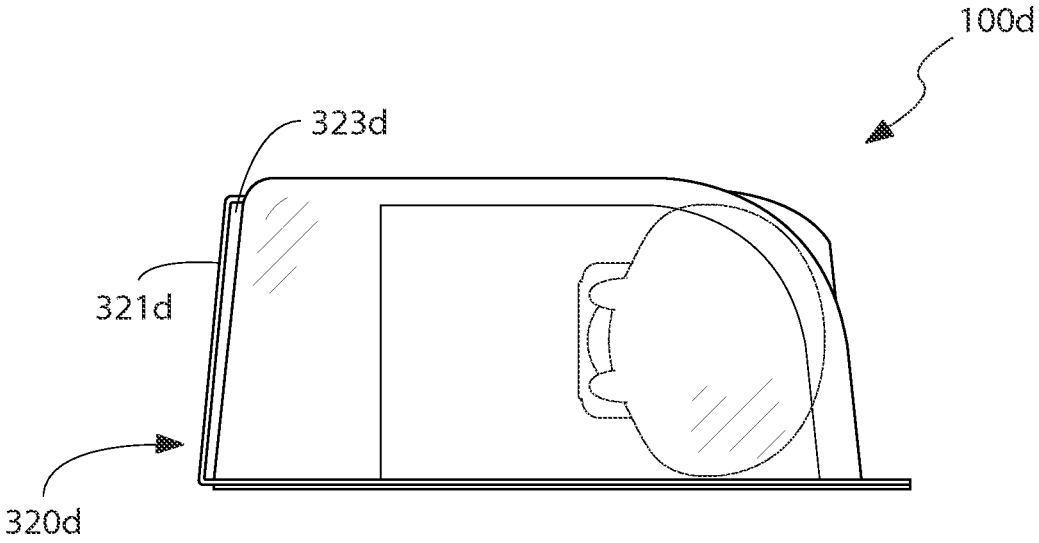
FIG. 6 is an alternative embodiment of a bottom view of an assembled package in accordance with the present disclosure.

In yet another example illustrated in FIG. 6, a package 100*d* may include a connecting portion 320*d* with little or no gap 323*d*, but with a tear strip (not shown) accessed on the face 321*d* of the connecting portion 320*d* for separating the connection between the first portion 310*d* and the second portion 330*d* of the backing 300*d*. In each of the above examples, the movement that results in the severing or separation of the connecting portion 320 occurs along a longitudinal plane 150 of the package 100 as shown in FIG. 2. Thus, the package 100 may be opened using one or more modes of separation defined along different planes 140 and/or 150.

The package 100 illustrated in the embodiment of FIGS. 1-5, may be assembled, for example, the second portion 330 of the backing 300 may first be attached to the display portion 220 of the container 200, and in particular to the first and second surfaces 222 and 224 (FIG. 5) of the display portion 220. The oral care implement 50 is provided in the interior 210 of the container 220 before or after the attachment of the second portion 330 of the backing 300 to the container 200 and is partially supported by a constraint that is partially defined by a portion 226 of the container 200 adjacent the gap 223 as shown in FIGS. 1 and 4. Such portion 226 stabilizes the implement 50 within the interior 210. The second portion 330 is attached to the display portion 220 of the container such that the oral care implement 50 is substantially unoccluded from view. Thereafter, the first portion 310 of the backing 300 is folded onto the periphery 230 of the container 200 such that a gap 323 is formed between the connecting portion 320 of the backing 300 and the container 200 as shown in FIG. 3, and the connecting portion 320 forming a spine of the package 100. The first portion 310 of the backing 300 is then sealed to the periphery 230 of the container 200 along edges 230*a*, 230*c*, and 230*d*, but not along edge 230*b* as described above, such as by heat sealing or the like to form a package 100 including an oral care implement 50. The connecting portion 320 of the backing 300 may be provided with a separable portion, such as, but not limited to, one or more weakened portion, perforation and/or tear strip, to facilitate separation of the first portion 310 of the backing 300 from the display portion 220 of the container 200.

While an exemplary method of forming the package 100 is described, it is understood that other suitable methods of forming the package 100 may be used.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A package for an oral care implement comprising:

a container having a display portion and a periphery; and a backing having a first portion attached to a portion of the periphery for defining an interior of the container for receiving an oral care implement, and a second portion attached to the display portion;

wherein the second portion of the backing further comprises a separable portion that facilitates removal of the second portion of the backing from the rest of the package, and wherein an access in the form of an elongated gap is defined between the separable portion and the display portion of the container, the elongated gap spans the length of the separable portion.

2. The package of claim 1, wherein the second portion of the backing is an integrally formed extension of the first portion.

3. The package of claim 1, further comprising a plurality of accesses defined along different planes.

4. The package of claim 3, wherein one access of the plurality is defined adjacent the display portion and one access of the plurality is defined along a side of the package.

5. The package of claim 1, wherein the separable portion is one of a removable tear strip, a weakened portion or a perforation.

6. The package of claim 1, wherein the periphery further comprises a plurality of edges and wherein the backing is sealed to at least one, but not all, of the plurality of edges.

7. The package of claim 6, wherein, the unsealed edge is defined along a junction of the first and second portions of the backing.

8. The package of claim 1, wherein the display portion further comprises a window for displaying an oral care implement, the window being substantially unoccluded by the backing.

9. The package of claim 1, the interior further comprising a toothbrush.

* * * * *